United States Patent [19]

Van Litsenburg

[11] 4,030,899

[45] June 21, 1977

[54] COOLING DEVICE

[75] Inventor: Joannes Wilhelmus Van Litsenburg, Eindhoven, Netherlands

[73] Assignee: U.S. Philips Corporation, New York, N.Y.

[22] Filed: Dec. 19, 1975

[21] Appl. No.: 642,329

[30] Foreign Application Priority Data

Feb. 24, 1975 Netherlands ..... 7502146

[52] U.S. Cl. ..... 62/514 R

[51] Int. Cl.[2] ..... F25B 19/00

[58] Field of Search ..... 62/118, 500, 514 R

[56] References Cited

UNITED STATES PATENTS

| | | | |
|---|---|---|---|
| 2,976,695 | 3/1961 | Meade | 62/54 |
| 3,266,262 | 8/1966 | Moragne | 62/54 |
| 3,908,397 | 9/1975 | Prast et al. | 62/514 R |
| 3,910,063 | 10/1975 | Prast | 62/514 R |

*Primary Examiner*—Ronald C. Capossela
*Attorney, Agent, or Firm*—Frank R. Trifari; Rolf E. Schneider

[57] ABSTRACT

A cooling device comprising a cooling element which is arranged in a reservoir space which contains a liquefied gas during operation. The cooling element has connected thereto an inlet duct for a cooled medium flow wherein, viewed downstream, a heat exchanger in thermal contact with the reservoir space and a restriction are successively included for blocking the medium flow in the case of an inadmissible temperature rise of the reservoir space.

4 Claims, 6 Drawing Figures

COOLING DEVICE

The invention relates to cooling devices, and particularly to devies wherein at least one closed space containing a liquefied gas during operation is maintained at a relatively low temperature. In such devices, the closed space accommodates at least one cooling element, the inlet of which communicates with an inlet duct for a flow of cooled medium, and the outlet of which communicates with a medium outlet duct. The ducts pass through at least one boundary wall of the space, the inlet duct including at least one restriction, and at least one heat exchanger is situated on the side of the restriction remote from the cooling element.

A cooling device of the kind set forth above is known from the published Netherlands Patent Application No. 7304884 corresponding to issued U.S. Pat. No. 3,908,397 issued Sept. 30, 1975.

In known cooling devices, the heat exchanger is included on one side in the medium inlet duct and on the other side in the medium outlet duct and constitutes, in conjunction with the restriction, a blocking device without moving parts. The blocking device at least substantially blocks the supply of cooled medium to the cooling element in the event of increased heat leakage from the surroundings to the reservoir space. The leakage becomes apparent as a significant temperature rise of the reservoir. The increased heat leakage can occur, for example, when the reservoir has a leaking vacuum jacket.

For the operation of the blocking device, use is made of the significant decrease in the density of circulating liquid cooling medium (transition liquid/gas) occurring due to the temperature rise in the reservoir, or of the combination of the decrease in the density and the increase in the viscosity of circulating gaseous cooling medium.

In a cooling device of the aforesaid kind reservoirs form part of the equipment together with the relevant cooling elements which are included in the same system of ducts as the cooling element. The reservoirs include a leaking reservoir, with other reservoirs remaining protected against the supply of heat which flows into the latter reservoir due to the leakage.

It is the main object of the present invention to provide a cooling device in which advantageous utilization is made of the presence of liquefied gas in its enclosed space, in combination with the pressure difference, and hence temperature difference, prevailing on both sides of the restriction.

In order to realize the foregoing object, the cooling device according to the invention is characterized in that at least one heat exchanger is arranged in the enclosed space, in good heat-exchange contact with the space.

In a preferred embodiment of the cooling device according to the invention, the enclosed space is subdivided into a liquid space and a vapour space. At least two series-connected heat exchangers are provided, the first heat exchanger viewed in the down-stream direction being arranged in the liquid space, and the second heat exchanger being arranged in the vapour space.

This arrangement offers the advantage, in the event of leakage of the reservoir, the flow of cooling medium to this reservoir is quickly blocked.

When use is made of a liquid cooling medium, the same cooling medium in the gaseous phase is always present therein due to the non-ideal heat insulation properites of the medium supply duct. During normal operation the medium in the gaseous phase at least substantially condenses in the heat exchanger due to the cooling by the liquefied gas in the reservoir. In the case of leakage of the reservoir, however additional gas is formed by evaporation of liquid cooling medium in the heat exchanger.

So as to stimulate the flow of the gaseous cooling medium component in the direction of the restriction rather than rise in the opposite direction into liquid cooling medium because of its lower specific weight, a further preferred embodiment of the cooling device according to the invention is characterized in that the inlet of the heat exchanger, or exchangers, is situated at a level in the space which is lower relative to the outlet.

In the event of leakage, a more rapid and effective blocking of the cooling medium flow is thus achieved and the gas is not liable to collect in the heat exchanger (exchangers) or medium inlet duct.

The invention will now be described in detail hereinafter with reference to the diagrammatic drawing, which is not to scale, and wherein.

Figure 1:
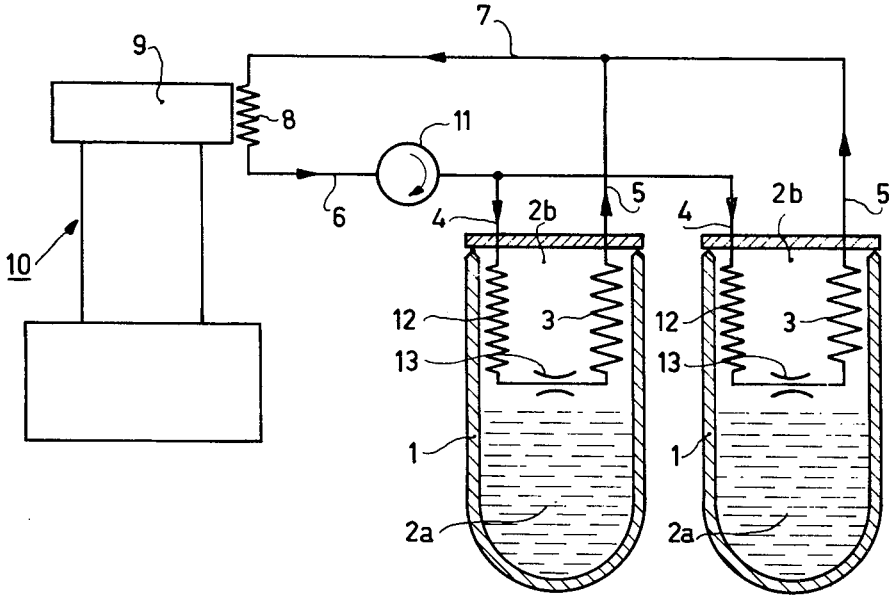
FIG. 1 is a longitudinal sectional view of a cooling device comprising a cooling medium which circulates in a closed system of ducts and which on the one side takes up cold from the cold head of a cold-gas refrigerator and which on the other side gives off cold to the vapour spaces of two storage vessels (Dewars) for liquefied gas.

The reference 1 in FIG. 1 denotes two Dewar vessels each of which contain a liquefied gas, such as liquid hydrogen under atmospheric pressure in liquid spaces 2*a*. A cooling coil 3 is arranged in the vapour space 2*b* of each of the vessels, each inlet of which is connected to an inlet duct 4 for cooled medium and each outlet is connected to an outlet duct 5. The inlet ducts 4 communicate with a main inlet duct 6, and the outlet ducts 5 communicate with a main outlet duct 7. A heat exchanger 8 for exchanging heat with the cold head 9 of a cold-gas refrigerator 10 communicates on the one side with the main inlet duct 6 and on the other side with the main outlet duct 7.

A pumping device 11, included in the main inlet duct 6, serves for the circulation of a cooling medium, such as liquid hydrogen, which is supplied to the inlet duct 4 by pumping device 11 under a pressure which is higher than the atmospheric pressure.

There is provided a heat exchanger 12 and a restriction 13 in each of the portions of the inlet ducts 4 which are situated in the vapour spaces 2*b*. The heat exchangers 12, like the cooling coils 3, are also in good thermal contact with the vapour spaces 2*b*.

The heat exchanger 12 in combination with restriction 13 in the same inlet duct 4 constitutes a blocking device which is passive during normal operation.

During normal operation, liquid hydrogen flows from heat exchanger 8 under a pressure of, for example 1.2 ata to the heat exchangers 12. Because the pressure of the liquefied hydrogen in heat exchanger 12 is higher than the atmospheric pressure of the hydrogen in Dewar vessel 1, the liquid hydrogen in heat exchanger 12 is at a higher temperature. This hydrogen is cooled by hydrogen vapour in space 2*b*.

Any gaseous hydrogen component formed elsewhere by heat leakage and flowing through the heat exchanger 12 condenses in this heat exchanger, so that only or substantially only liquid hydrogen enters restriction 13. Because of the high density of this liquid hydrogen, the restriction 13 offers comparatively little resistance against the passage of this liquid hydrogen. On passing the restriction 13 its hydrogen undergoes a pressure decrease, and hence a temperature decrease occurs in the liquid hydrogen. The liquid hydrogen in the cooling coil 3 thus ensures that hydrogen vapour in vapour space 2*b* formed by normal heat leakage condenses again in the Dewar vessel 1.

Should the vacuum jacket of one of the two Dewar vessels start to leak, the large quantity of inflowing heat causes the temperature and the pressure in the leaking Dewar vessel to increase substantially. The liquid hydrogen flowing through the relevant heat exchanger 12 is then heated thereby causing it to evaporate. Instead of liquid hydrogen, gaseous hydrogen then flows to the relevant restriction 13. Because the density of gaseous hydrogen is considerably smaller than that of liquid hydrogen the restriction 13 represents a relatively high resistance for the hydrogen gas so that substantially no hydrogen gas passes this restriction, with the result that the supply of hydrogen to the relevant cooling coil 3 is substantially completely blocked. The flow of liquid hydrogen delivered by the pumping device 11 is then substantially exclusively applied to the cooling coil of the Dewar vessel which is still in order. It is thus ensured that the latter Dewar vessel is not impeded by a high heat loss in the leaking Dewar vessel.

If a gas, for example helium under pressure, is used as a cooling medium in the closed system of ducts shown in FIG. 1, the gas will be substantially heated in the relevant heat exchanger in the case of leakage of a Dewar vessel. As a result, the density of this gas substantially decreases, and its viscosity increases. The relevant restriction then constitutes a large resistance for the heated gas and the gas flow is substantially blocked.

In the FIGS. 2 to 6 the same reference numerals have been used as for the components referred to in FIG. 1.

Figure 2:
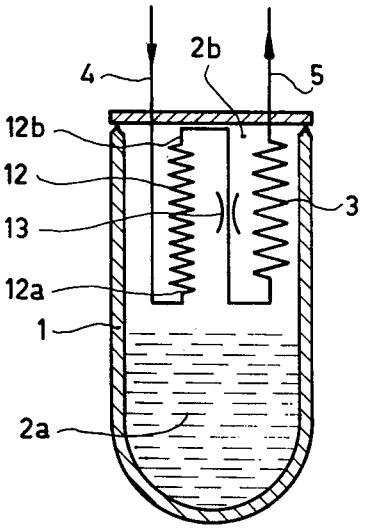
FIGS. 2, 3, 4, 5 and 6 are longitudinal sectional views of various alternatives of the portion of the cooling device, arranged inside a Dewar vessel as shown in FIG. 1.

In FIG. 2 the heat exchanger 12 is arranged in the vapour space 2*b* such that the inlet 12*a* is situated at a lower level and the outlet 12*b* is situated at a higher level. When use is made of a liquid cooling medium, a gaseous component present therein will tend to rise in the liquid contained in the heat exchanger 12 because of its lower specific density causing it to flow in the desired direction towards the restriction, rather than in the direction of the inlet duct 4. Consequently, the gas is not liable to collect in the heat exchanger 12, which would impede the operation of the blocking mechanism. In the case of leakage, therefore, the blocking mechanism will respond more quickly. The remaining parts of its process of the blocking mechanism are similar in operation to that of the mechanism shown in FIG. 1.

Figure 3:
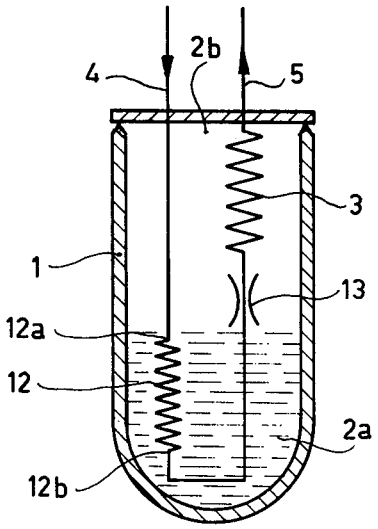

The embodiment shown in FIG. 3 is similar to FIG. 1 with the exception that in the present case the heat exchanger 12 is arranged in the bath of liquefied gas instead of in the vapour space 2*b*.

Figure 4:
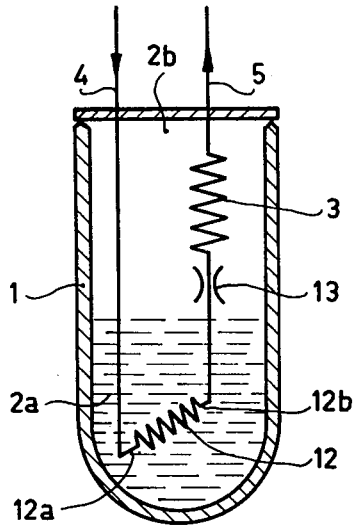

FIG. 4 deviates from FIG. 3 as regards the arrangement of the heat exchanger 12. In FIG. 4 the heat exchanger 12 is arranged at an angle such that the inlet 12*a* is situated at a level which is lower than that of the outlet 12*b* for the reasons described with reference to FIG. 2.

Figure 5:
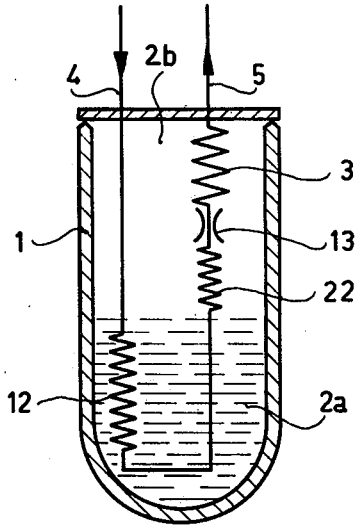

In FIG. 5, a second heat exchanger 22, arranged in the vapour space 2*b*, is provided in series with the heat exchanger 12 arranged in the liquid space 2*a*.

In the case of leakage of Dewar vessel 1, the blocking mechanism will then react quicker because of the extra quick heating of the cooling medium in heat exchanger 22.

The heat transfer (due to condensation of vapour) is better for heat exchanger 22 than for heat exchanger 12 (due to heat transfer by thermal conduction of the liquid bath) when the pressure and the temperature in the Dewar vessel increase.

Figure 6:
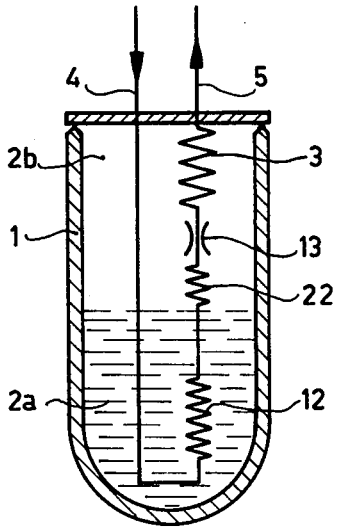

FIG. 6 deviates from FIG. 5 merely in that not only heat exchanger 22 but also heat exchanger 12 has its inlet arranged at a low level and its outlet at a higher level in Dewar vessel 1.

In the embodiments shown, the cooling coil 3 and the restriction 13 are always arranged in the vapour space2*b*. Obviously, it is alternatively possible to arrange the cooling coil 3 and/or the restriction 13 in the liquid space 2*a*.

It is understood that the use of the cooling device is not limited to cryogenic temperatures (e.g. to Dewar vessels with liquid helium, liquid hydrogen, liquid neon or liquid nitrogen) in that it can also be used at higher temperatures (liquid hydrocarbons such as natural gas).

The circulating cooling medium can be cooled in a variety of ways. Cooling can be effected, for example, in addition to cold-gas refrigerators in a Joule-Kelvin system or in an evaporation/condensation system (compression refrigerator) etc.

What is claimed is:

1. A cooling device for maintaining a low operating temperature in an enclosure, comprising boundary means defining said enclosure and containing a liquefied gas, said enclosure having an inlet duct conveying a flow of cooled medium to said enclosure, and an outlet duct for conveying said cooled medium from said enclosure, said ducts passing through at least one boundary wall defining said enclosure, the path between said inlet duct and said outlet duct including the serial connection of a heat exchanger, a restriction means and a cooling element, said restriction means being situated between said heat exchanger and said cooling element, said heat exchanger being coupled in good heat exchanging contact in said enclosure.

2. The coolind device of claim 1 wherein the inlet of said heat exchanger is contained within said enclosure at a level which is lower than the outlet of said heat exchanger.

3. A cooling device as claimed in claim 1 wherein said enclosure is divided into a liquid space and a vapor space, and further comprising a further heat exchanger series connected with said first mentioned heat exchanger, the first heat exchanger viewed in the cooling medium flow direction being arranged in said liquid space and the further heat exchanger being arranged in said vapor space.

4. The cooling device of claim 3 wherein the inlet of each respective one of said heat exchangers is contained within said enclosure at a level which is lower than the outlet of each said same respective one of heat exchanger.

* * * * *